US008833678B2

(12) United States Patent
Reiter

(10) Patent No.: US 8,833,678 B2
(45) Date of Patent: Sep. 16, 2014

(54) ELECTROMAGNETICALLY OPERATABLE VALVE

(75) Inventor: Ferdinand Reiter, Markgroeningen (DE)

(73) Assignee: Robert Bosch GmbH, Stuttgart (DE)

( * ) Notice: Subject to any disclaimer, the term of this patent is extended or adjusted under 35 U.S.C. 154(b) by 889 days.

(21) Appl. No.: 12/097,466

(22) PCT Filed: Oct. 30, 2006

(86) PCT No.: PCT/EP2006/067911

§ 371 (c)(1),
(2), (4) Date: Oct. 28, 2008

(87) PCT Pub. No.: WO2007/073964

PCT Pub. Date: Jul. 5, 2007

(65) Prior Publication Data

US 2009/0134348 A1 May 28, 2009

(30) Foreign Application Priority Data

Dec. 22, 2005 (DE) ..... 10 2005 061 410

(51) Int. Cl.
*B05B 1/30* (2006.01)
*F02M 51/06* (2006.01)
*H01F 7/16* (2006.01)

(52) U.S. Cl.
CPC ... *F02M 51/0614* (2013.01); *F02M 2200/8023* (2013.01); *H01F 7/1638* (2013.01); *F02M 2200/8061* (2013.01)
USPC ..... 239/585.1; 239/585.4

(58) Field of Classification Search
CPC ..... F02M 51/0621; F02M 51/066
USPC ..... 239/585.1–585.5, 584, 533.2, 533.11; 251/127, 129.15, 129.51
See application file for complete search history.

(56) References Cited

U.S. PATENT DOCUMENTS

| | | | | |
|---|---|---|---|---|
| 5,407,131 | A * | 4/1995 | Maley et al. | 239/90 |
| 5,417,403 | A * | 5/1995 | Shurman et al. | 251/129.16 |
| 5,544,816 | A * | 8/1996 | Nally et al. | 239/585.5 |
| 5,687,468 | A | 11/1997 | Hans et al. | |
| 5,927,614 | A * | 7/1999 | Touvelle et al. | 239/585.1 |
| 6,109,543 | A * | 8/2000 | Bright et al. | 239/135 |
| 2003/0127544 | A1 | 7/2003 | Demere et al. | |

FOREIGN PATENT DOCUMENTS

| | | |
|---|---|---|
| DE | 44 21 935 | 6/1995 |
| DE | 442 1935 | 6/1995 |
| DE | 196 31 280 | 2/1998 |
| EP | 0 352 445 | 1/1990 |
| JP | 2003-269290 | 9/2003 |
| JP | 2004-100676 | 4/2004 |
| JP | 2005-507177 | 3/2005 |
| WO | WO 2005-061150 | 7/2005 |
| WO | WO 2005-064148 | 7/2005 |

* cited by examiner

*Primary Examiner* — Davis Hwu
(74) *Attorney, Agent, or Firm* — Kenyon & Kenyon LLP

(57) ABSTRACT

The electromagnetically operatable valve, in particular a fuel injector for fuel injection systems of internal combustion engines, has a magnetic circuit having a core, a solenoid, a bobbin accommodating the winding of the solenoid, an armature, which operates a valve closing body cooperating with a fixed valve seat and is drawn against the core when the solenoid is excited, and having an armature-side flow guide element. The bobbin is designed and situated in such a way that magnetic isolation between the core and the armature-side flow guide element is ensured. The valve is suitable in particular for use in fuel injection systems of mixture-compressing, externally ignited internal combustion engines.

14 Claims, 3 Drawing Sheets

ELECTROMAGNETICALLY OPERATABLE VALVE

BACKGROUND INFORMATION

FIG. 1 shows a fuel injector known from the related art, having a conventional three-part design of an internal metallic flow guide part and a housing component. This internal valve tube is formed by an inlet connecting piece forming an internal pole, a non-magnetic intermediate part and a valve seat carrier accommodating a valve seat and is elucidated in greater detail in the description of FIG. 1.

German Patent Application No. DE 44 21 935 describes such an electromagnetically operatable valve in the form of a fuel injector. The internal valve tube forms the basic skeleton of the entire injector and has an essential supporting function in its entirety for the three individual components. The non-magnetic intermediate part is tightly and fixedly connected to both the inlet connecting piece and the valve seat carrier by welds. The windings of a solenoid are inserted into a plastic coil carrier, which in turn surrounds in the circumferential direction a part of the inlet connecting piece used as an internal pole and also surrounds the intermediate part. A wedge-shaped surface which is variably manufacturable according to a magnetic and hydraulic optimum is provided prior to applying a wear-resistant layer on the mutually contacting components of armature and/or internal pole.

The annular contact section formed by the wedge shape has a defined contact surface width, which remains largely constant over its entire service life because contact surface wear in long-term operation does not result in an enlargement of the contact width. The axially movable armature is guided by an internal guide surface of the intermediate part.

SUMMARY OF THE INVENTION

The electromagnetically operatable valve according to the present invention has the advantage that a simplified and cost-effective assembly of the valve is implementable because the non-magnetic intermediate part may be omitted. The bobbin advantageously assumes the additional function of magnetic isolation in the electromagnetic circuit and increases the stability in the area of the solenoid. Integral joining methods such as welding, which have the disadvantage of thermal distortion, are not used. Rather, particularly advantageous plastic-metal pressure bonds may be used which are applicable in a simple, very safe, and reliable manner. The system according to the present invention also has the advantage of a reduction of the structure-borne noise and thus of noise generation compared to known approaches.

It is advantageous in particular if the core and the armature-side flow guide element are secured by pressing them into the bobbin or into the insert surrounded by the bobbin and possibly connected to it. The plastic-metal pressure bonds may be produced in a particularly safe and reliable manner if sawtooth-like structures are provided in the overlapping areas of the bobbin or the insert and the core, as well as the flow guide element. In the pressed-in state of the core and the flow guide element in the bobbin or in the insert surrounded by the bobbin, the sawtooth-like structure of the core and the flow guide element matches the directly opposite surface of the bobbin or the insert surrounded by the bobbin in that the sawtooth-like structure penetrates the plastic and the plastic relaxes.

It is also advantageous to provide a guide area for the armature directly on the bobbin or on the insert.

DETAILED DESCRIPTION

Figure 1:
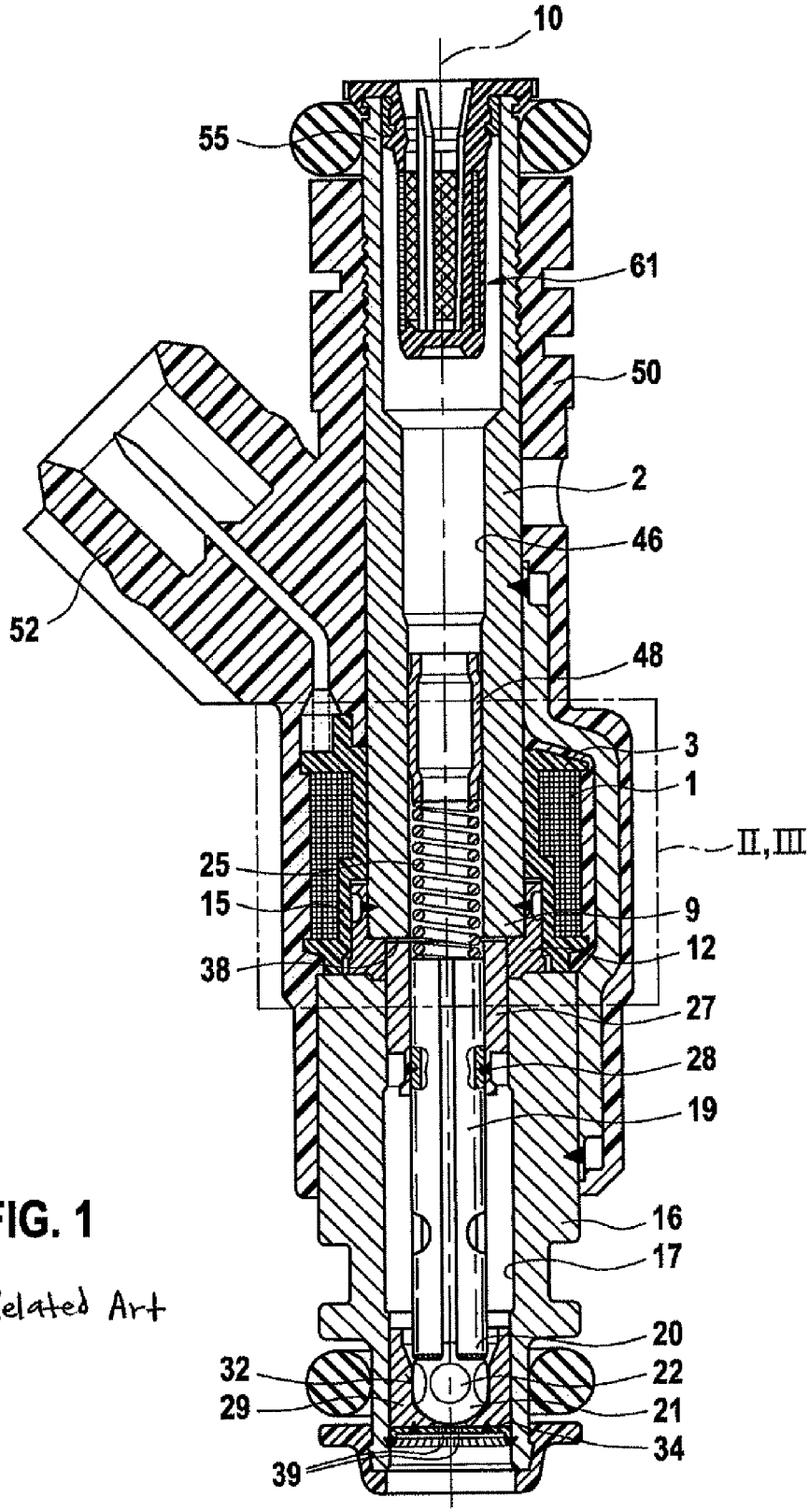
FIG. 1 Related Art
FIG. 1 shows a fuel injector as an example of an electromagnetically operatable valve according to the related art.

The electromagnetically operatable valve in the form of an injector for fuel injection systems of mixture-compressing, externally ignited internal combustion engines, shown in FIG. 1 as an example, has a core 2, which is designed here in the form of a tube surrounded by a solenoid 1, has a constant external diameter over its entire length, and functions as the internal pole and fuel inlet connecting piece. A bobbin 3 having steps in the radial direction accommodates a winding of solenoid 1 and, in combination with core 2, allows a compact design of the injector in the area of solenoid 1.

A tubular metallic non-magnetic intermediate part 12 is attached tightly, e.g., by welding, to a lower core end 9 of core 2 in such a way that it is concentric with a longitudinal valve axis 10, and thereby partially surrounds core end 9 axially. Stepped bobbin 3 partially surrounds core 2 and, with a step 15 of a larger diameter, axially surrounds intermediate part 12 at least partially. Downstream from bobbin 3 and intermediate part 12, a tubular valve seat carrier 16 extends and is fixedly connected to intermediate part 12. A longitudinal borehole 17, which is designed to be concentric with longitudinal valve axis 10, runs in valve seat carrier 16. At its downstream end 20, a tubular valve needle 19 provided in longitudinal borehole 17 is attached by welding, for example, to a spherical valve closing body 21 on whose circumference five flattened areas 22, for example, are provided to allow the flow of fuel past it.

The injector is operated electromagnetically in a known way. The electromagnetic circuit having solenoid 1, core 2, and an armature 27 functions to provide the axial movement of valve needle 19 and thus to open it against the spring force of a restoring spring 25 and/or to close the injector. Armature 27 is attached to the end of valve needle 19 facing away from valve closing body 21 by a weld 28 and is aligned with core 2. A cylindrical valve seat body 29 having a fixed valve seat is tightly installed by welding in longitudinal borehole 17 in the downstream end of valve seat carrier 16 facing away from core 2.

A guide opening 32 of valve seat body 29 acts to guide valve closing body 21 during the axial movement of valve needle 19 with armature 27 along longitudinal valve axis 10. Spherical valve closing body 21 cooperates with the valve seat of valve seat body 29, which tapers in the form of a truncated cone in the direction of flow. On its end facing away from valve closing body 21, valve seat body 29 is fixedly and concentrically connected to an injection hole disk 34 designed in the shape of a pot, for example. At least one, e.g., four spray opening(s) 39 shaped by erosion or punching, run(s) in the bottom part of injection hole disk 34.

The insertion depth of valve seat body 29 with pot-shaped injection hole disk 34 determines the preliminary setting of the lift of valve needle 19. One end position of valve needle 19 when solenoid 1 is not excited is determined by the contact of valve closing body 21 with the valve seat of valve seat body 29, while the other end position of valve needle 19 when solenoid 1 is excited is determined by the contact of armature 27 with core end 9.

An adjustment sleeve 48 inserted into a flow borehole 46 of core 2 running concentrically with longitudinal valve axis 10, the adjustment sleeve being shaped from rolled spring steel sheet, for example, functions as an adjustment of the spring pretension of restoring spring 25, which rests on adjustment sleeve 48 and is supported at its opposite end on valve needle 19. The injector is largely surrounded by a plastic sheathing 50. This plastic sheathing 50 includes, for example, an integrally molded electric plug connector 52. A fuel filter 61 protrudes into flow borehole 46 of core 2 at its inlet end 55 to filter out fuel constituents which might cause blockage or damage in the injector due to their size.

Figure 2:
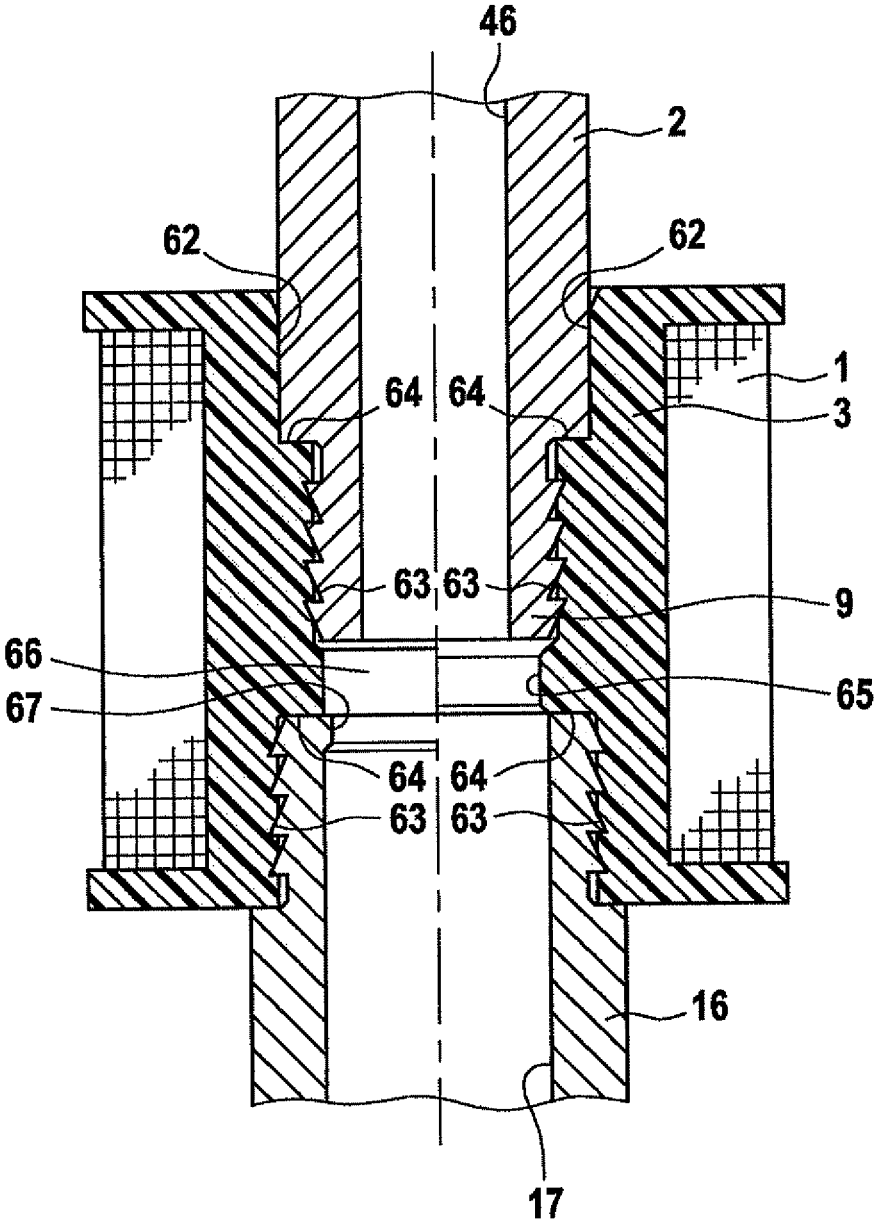
FIG. 2 shows two exemplary embodiments of a bobbin according to the present invention in an enlarged representation according to detail II in FIG. 1.

FIG. 2 shows a first and a second exemplary embodiment of a bobbin 3 according to the present invention in an enlarged representation according to detail II in FIG. 1. Plastic bobbin 3 according to the present invention is characterized in that it assumes the function of known intermediate part 12. On the right side of FIG. 2 a first example of a bobbin 3 is shown which has a stepped internal opening 62. At least in a certain overlap area of bobbin 3 and core 2 or valve seat carrier 16, in the area of internal opening 62, the internal wall of bobbin 3 is designed with a largely flat surface which is somewhat offset inward. This surface of bobbin 3 matches a sawtooth-like structure 63 at core end 9 of core 2, or at the upper end of valve seat carrier 16. Both core 2 and valve seat carrier 16 are pressed into internal opening 62 of bobbin 3 to produce fixed connections with bobbin 3, specifically in such a way that structure 63 is securely and non-rotatably hooked and spread on the surface of bobbin 3. Sawtooth-like structure 63 of metallic component 2, 16 thus penetrates the plastic of bobbin 3, and the plastic subsequently relaxes. The press-in depth into bobbin 3 for these components may be established by appropriate shoulders 64 on core 2 and valve seat carrier 16, on which core 2 and valve seat carrier 16 then rest in the pressed-in state. Instead of valve seat carrier 16, another metallic component in the form of a nozzle body or an armature-side flow guide element may be provided, which is pressed into bobbin 3.

Figure 3:
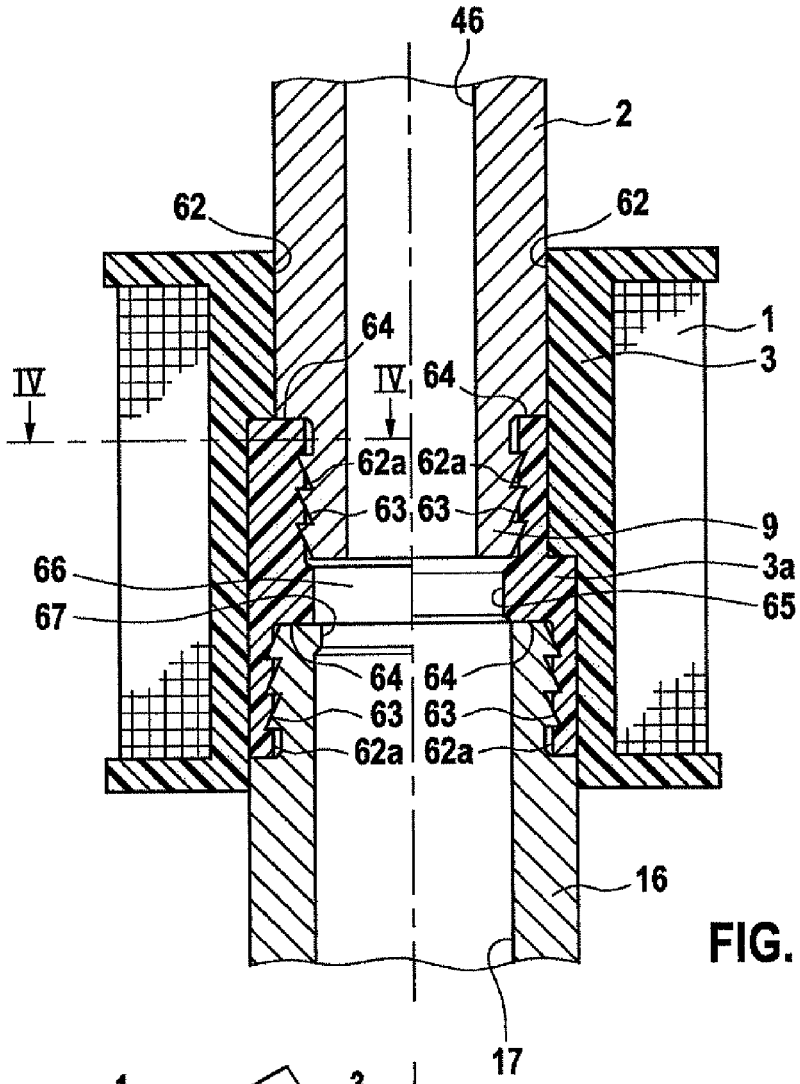
FIG. 3 shows two further exemplary embodiments of a bobbin according to the present invention having an additional insert in an enlarged representation according to detail III in FIG. 1.

Axially movable armature 27, which is fixedly connected to valve needle 19 and is not illustrated in FIGS. 2 and 3, is guided on the right side of FIG. 2, for example, by a guide collar 65 on bobbin 3, projecting radially inward, which, viewed in the axial direction of bobbin 3, lies between the two structures 63. Guide collar 65 of bobbin 3 thus extends into a gap 66 between core end 9 of core 2 and valve seat carrier 16. Guide collar 65 has a somewhat smaller internal diameter than the diameter of longitudinal borehole 17 of valve seat carrier 16 to be able to securely surround armature 27 during its axial movement. In contrast, on the left side of FIG. 2, axially movable armature 27 is guided, for example, by a guide collar 67, projecting radially inward, on the upper end of valve seat carrier 16. Also in this exemplary embodiment, the material of bobbin 3 slightly extends into gap 66 between core end 9 of core 2 and valve seat carrier 16.

In the absence of a non-magnetic intermediate part, bobbin 3 itself advantageously assumes the additional function of magnetic isolation in the electromagnetic circuit and increases the stability in the area of solenoid 1. Integral joining methods such as welding, which have the disadvantage of a thermal distortion, are not used.

FIG. 3 shows a third and a fourth exemplary embodiment of bobbin 3 according to the present invention in an enlarged representation according to detail III in FIG. 1. Contrary to the exemplary embodiments illustrated in FIG. 2, the examples of FIG. 3 are distinguished by bobbin 3 being designed in two parts. For this purpose, bobbin 3 has an internal insert 3*a*, which has a thin wall and its stepping matches the stepped internal opening 62 of bobbin 3. Bobbin 3 according to the present invention, together with its plastic insert 3*a*, is characterized in that it assumes the function of known intermediate part 12. On the right side of FIG. 3 a third example of a bobbin 3 is shown which has a stepped internal opening 62. Internal opening 62 of bobbin 3 is designed with smooth walls for accommodating stepped insert 3*a*, in such a way that bobbin 3 surrounds insert 3*a*. In a certain overlap area of insert 3*a* and core 2 or valve seat carrier 16, in the area of internal opening 62*a*, the internal wall of insert 3*a* is designed with a largely flat surface. This surface of insert 3*a* matches a sawtooth-like structure 63 on core end 9 of core 2 or on the upper end of valve seat carrier 16. Both core 2 and valve seat carrier 16 are pressed into internal opening 62*a* of insert 3*a* to produce fixed connections with bobbin 3, specifically in such a way that structure 63 is securely and non-rotatably hooked and spread on the surface of insert 3*a*. Sawtooth-like structure 63 of metallic component 2, 16 thus penetrates the plastic of insert 3*a* and the plastic subsequently relaxes. The press-in depth for these components into insert 3*a* may be established by appropriate shoulders 64 on core 2 and valve seat carrier 16, on which core 2 and valve seat carrier 16 then rest in the pressed-in state. Instead of valve seat carrier 16, another metallic component in the form of a nozzle body or an armature-side flow guide element may be provided, which is pressed into insert 3*a*.

On the right side of FIG. 3, axially movable armature 27 is guided, by a guide collar 65 projecting radially inward on insert 3*a* which, viewed in the axial direction of insert 3*a*, lies between the two structures 63 of insert 3*a*, for example. Guide collar 65 of insert 3*a* thus extends into a gap 66 between core end 9 of core 2 and valve seat carrier 16. In contrast, on the left side of FIG. 3, axially movable armature 27 is guided by a guide collar 67 projecting radially inward on the upper end of valve seat carrier 16, for example. Also in this exemplary embodiment, the material of insert 3*a* slightly extends into gap 66 between core end 9 of core 2 and valve seat carrier 16.

Figure 4:
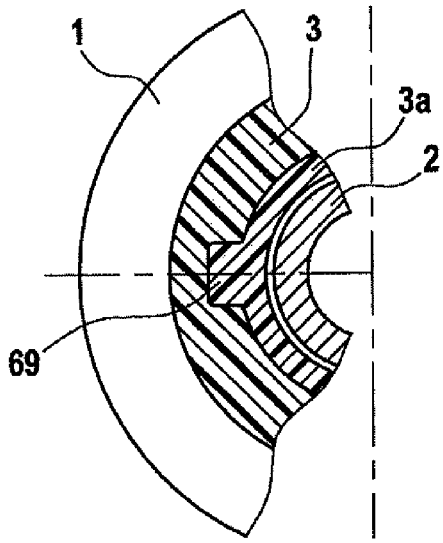
FIG. 4 shows a section through the bobbin and the insert along line IV-IV in FIG. 3.

FIG. 4 shows a section through bobbin 3 and insert 3*a* along line IV-IV in FIG. 3. Insert 3*a* has a molded element 69, for example, in the form of a projection, which is used as an anti-rotation device and engages in a matching recess of bobbin 3. In this way, using a positive locking connection, a defined installation position of bobbin 3 with respect to core 2 and valve seat carrier 16 may be ensured and slippage of bobbin 3 with respect to insert 3*a* may be avoided.

The present invention is not limited to an application in a fuel injector, but may also be used in different types of electromagnetically operatable valves in which, when solenoid 1 is excited, magnetic field lines are guided by a flow guide element 16 via a movable armature 27 and a fixed core 2.

What is claimed is:

1. An electromagnetically operatable valve comprising:

a longitudinal valve axis;

a core;

a solenoid;

a bobbin accommodating a winding of the solenoid;

a valve closing body;

a fixed valve seat;

an armature which operates the valve closing body cooperating with the fixed valve seat and is drawn against the core when the solenoid is excited; and an armature-side flow guide element, wherein the bobbin or an insert surrounded by the bobbin is designed and situated in such a way that magnetic isolation between the core and the armature-side flow guide element is ensured; and wherein the bobbin or the insert surrounded by the bobbin has a stepped internal opening into which the core and the armature-side flow guide element at least partially project, the core and the armature-side flow guide element being connected directly to an inner wall of the bobbin or connected directly to an inner wall of the insert surrounded by the bobbin.

2. The valve according to claim 1, wherein the valve is a fuel injector for a fuel injection system of an internal combustion engine.

3. The valve according to claim 1, wherein the bobbin or the insert surrounded by the bobbin is composed of a plastic.

4. The valve according to claim 1, wherein the core and the armature-side flow guide element are secured by pressing them into the bobbin or into the insert surrounded by the bobbin.

5. The valve according to claim 1, wherein sawtooth-like structures are situated in an overlap area of the bobbin or the insert and the core, as well as the flow guide element.

6. The valve according to claim 5, wherein, in the pressed-in state of the core and the flow guide element in the bobbin or in the insert surrounded by the bobbin, the sawtooth-like structure of the core or the flow guide element matches a directly opposite surface of the bobbin or the insert surrounded by the bobbin.

7. The valve according to claim 1, wherein the armature is guided with the aid of a guide collar on the bobbin or on the insert surrounded by the bobbin, projecting radially inward.

8. The valve according to claim 7, wherein the guide collar extends into a gap between the core and the flow guide element.

9. The valve according to claim 1, wherein the armature is guided with the aid of a guide collar on an upper end of the flow guide element, projecting radially inward.

10. The valve according to claim 1, wherein the insert is secured and prevented from rotating by a molded element on the bobbin.

11. The valve according to claim 1, wherein the armature-side flow guide element is designed as a valve seat carrier or a nozzle body.

12. The valve according to claim 1, wherein the insert is composed of a plastic.

13. An electromagnetically operatable valve, comprising:

a longitudinal valve axis;

a core;

a solenoid;

a bobbin accommodating a winding of the solenoid;

an insert surrounded by and torsionally fixed on the bobbin;

an armature which operates a valve closing body cooperating with a fixed valve seat and is drawn against the core when the solenoid is excited; and an armature-side flow guide element;

wherein the bobbin and the insert are designed and situated in such a way that magnetic isolation between the core and the armature-side flow guide element is ensured, the bobbin and the insert being composed of a plastic; and wherein the insert is non-integrally connected to the core and the armature-side flow guide element.

14. The valve according to claim 13, wherein:

the core and the armature-side flow guide element each include sawtooth-like structures formed of metal, and the sawtooth-like structures penetrate the plastic of the insert such that the sawtooth-like structures are securely and non-rotatably hooked and spread on respective surfaces of the insert, where the insert overlaps with the core and the armature-side flow guide element.

* * * * *